US006595836B2

(12) United States Patent
Hong

(10) Patent No.: US 6,595,836 B2
(45) Date of Patent: Jul. 22, 2003

(54) CALIBRATION DEVICE FOR PAD CONDITIONER HEAD OF A CMP MACHINE

(75) Inventor: Yong-Sung Hong, Yongin-shi (KR)

(73) Assignee: Samsung Electronics Co., Ltd., Suwon (KR)

( * ) Notice: Subject to any disclaimer, the term of this patent is extended or adjusted under 35 U.S.C. 154(b) by 92 days.

(21) Appl. No.: 09/970,691

(22) Filed: Oct. 5, 2001

(65) Prior Publication Data

US 2002/0137441 A1 Sep. 26, 2002

(30) Foreign Application Priority Data

Mar. 20, 2001 (KR) ..... 2001-14320

(51) Int. Cl.[7] ..... B24B 7/00

(52) U.S. Cl. ..... 451/72; 451/287; 451/285; 33/483; 33/679.1

(58) Field of Search ..... 451/72, 60, 41, 451/28, 11, 364, 288, 287, 285; 33/833, 483, 679.1

(56) References Cited

U.S. PATENT DOCUMENTS 5,444,921 A * 8/1995 Milina ..... 33/833
5,948,203 A * 9/1999 Wang ..... 451/72
6,116,989 A * 9/2000 Balastik ..... 451/72
6,139,428 A * 10/2000 Drill et al. ..... 451/41
6,514,121 B1 * 2/2003 Halley ..... 451/5

* cited by examiner

*Primary Examiner*—Lee D. Wilson
(74) *Attorney, Agent, or Firm*—Volentine Francos, PLLC

(57) ABSTRACT

A calibration device for a pad conditioner head of a CMP machine includes a lower first horizontal member defining an arcuate reference surface having a shape complementary to that of the outer peripheral edge of the platen of the machine, an upper second horizontal member spaced vertically from the first member and having a reference mark thereon lying in the projected plane of the reference surface, and a connecting member interconnecting the first member and second member. When the reference surface of the first horizontal member of the calibration device is be butted against the outer peripheral edge of the platen adjacent the head of the pad conditioner, the location of the outermost portion of the head of the pad conditioner relative to the reference mark is readily observable. Thus, the extent to which the outermost portion of the head of the pad conditioner is vertically aligned relative to the outer peripheral edge of the platen can be easily and accurately determined.

20 Claims, 5 Drawing Sheets

CALIBRATION DEVICE FOR PAD CONDITIONER HEAD OF A CMP MACHINE

BACKGROUND OF THE INVENTION

1. Field of the Invention

The present invention relates to the chemical-mechanical polishing (CMP) process used in the manufacturing of semiconductor devices. More particularly, the present invention relates to the pad conditioner head of a CMP machine.

2. Description of the Related Art

In the fabrication of integrated circuits of a semiconductor device, a chemical-mechanical polishing (CMP) process is generally used to reduce step coverage, or to form contact plugs and wires in a damascene manner. To this end, the CMP process uses mechanical friction and a chemical reaction to remove material from the surface of a wafer. In the CMP process, a polishing head presses a wafer against an abrasive pad and rotates the wafer, whereby the wafer is mechanically polished. Also, during this time, a slurry arm supplies a slurry of abrasive particles into a small gap between the wafer and the abrasive pad to chemically remove silicon oxides from the wafer. CMP is very efficient in removing material from the surface of a wafer because CMP makes use of both mechanical and chemical processes. Also, the use of a chemical reaction allows for only selected material to be removed from the surface of a wafer.

However, a precise surface roughness and elasticity of the abrasive pad and a specified contact pressure between the wafer and the abrasive pad have to be established if the CMP process is to remove material precisely from the surface of a wafer. Also, the slurry has to be uniformly distributed in the gap between the surface of the wafer and the abrasive pad. Accordingly, the abrasive pad is precisely fabricated to satisfy these requirements. If, however, the characteristics of the abrasive pad change significantly after the pad has been used for a given period of time, it has to be replaced. Moreover, the abrasive pad is an expensive consumable article of manufacture. Therefore, its frequent replacing has a noticeable impact on the manufacturing cost of the semiconductor devices.

Accordingly, the abrasive pad needs to be maintained for a long period of time. To meet this need, a pad conditioner is used to condition the surface of the abrasive pad so that the surface remains uniform for as long as possible. The pad conditioner evens out irregularities in the surface contour of the abrasive pad and remove surplus slurry from the surface of the abrasive pad so that the slurry is distributed uniformly across the surface of the abrasive pad. The pad conditioner also trims the surface of the abrasive pad so that a given surface roughness is maintained. Thus, the pad conditioner prolongs the useful life of the abrasive pad and maintains the condition of the pad until its useful life is over.

FIG. 1 is a schematic plan view of a conventional CMP machine. The CMP machine has several working area P1, P2, P3. A respective abrasive pad 11, a slurry arm 13, and a pad conditioner 15 having a head 21 are disposed in each working area. The abrasive pad 11 is mounted on a circular platen (23 of FIG. 3). The slurry arm 13 and the pad conditioner 15 are disposed in a first corner of the working area. On the other hand, a respective polishing head 19 is disposed over the abrasive pad 11 at a second corner of each working area opposite to that corner at which the slurry arm 13 and the pad conditioner 15 are disposed. The polishing head 19 chucks a wafer 17 by vacuum or surface tension during the CMP process in which, as mentioned above, the wafer 17 is pressed by the polishing head against the abrasive pad 11 while the abrasive pad 11 is rotated (by the platen 23) and the slurry arm 13 supplies slurry into the gap between the contacting surfaces of the wafer 17 and the abrasive pad 11.

Subsequently, the head 21 of the pad conditioner 15 is moved onto the abrasive pad 11 from a stand-by position in a clean cup. The head 21 has a diamond-encrusted disk mounted thereto. The head 21 evens out the surface of the abrasive pad 11 by sweeping the disk across the pad 11 over a certain angle, whereby the centers of the platen 23 and the head 21 of the pad conditioner 15 are moved within a certain range relative to each other.

To maintain a sufficient surface roughness of the abrasive pad 11, the head 21 of the pad conditioner 15 has to be swung to the left and right within a given working range. If the movement of the pad conditioner 15 deviates from the given working range, excess slurry can remain on a portion of the abrasive pad 11, or steps or defective abrasive portions can be formed on the surface of the abrasive pad 11. Steps at the surface of the abrasive pad 11 may cause the wafer to be improperly polished. As a result, chips of inferior quality may be produced at a portion of the wafer 17.

Therefore, in preparation for the CMP process, the pad conditioner 15 is first adjusted to limit its movement within the desired given working range, however, components of the CMP machine may be mechanically altered as the CMP process is being carried out. Accordingly, it is necessary to frequently calibrate the head 21 of the pad conditioner 21, i.e., set the head 21 in place in a reference position.

Referring to FIG. 2 and FIG. 3, the head 21 is so calibrated by vertically aligning the outer peripheral edge thereof with the outer peripheral edge of the platen 23. Up until now, the pad conditioner head 21 has been calibrated in this way by eye. However, it is not possible to accurately calibrate the head 21 consistently and correctly by eye. In particular, it is very difficult to discern whether the edge of the head 21 is vertically aligned with the edge of the platen 23 because the abrasive pad 11 protrudes outwardly beyond the edge of the platen 23.

Accordingly, the head 21 is often improperly calibrated, whereby the pad conditioner 15 operates outside the desired working range when conditioning the abrasive pad. As a result, excess slurry can be remain on a portion of the abrasive pad 11, or steps or defective abrasive portions can be formed on the surface of the abrasive pad 11. As a result, inferior chips are often produced.

SUMMARY OF THE INVENTION

It is an object of the present invention to provide a device by which a pad conditioner head of a CMP machine can be correctly calibrated, especially in the case in which the abrasive pad of the CMP machine protrudes radially outwardly beyond an outer peripheral edge of the circular platen to which the pad is mounted.

The present invention achieves this abject by providing by a calibration device that includes a first horizontal member having a radially innermost end defining a concave arcuate reference surface having a shape complementary to that of a portion of the outer peripheral edge of the platen, a second horizontal member extending radially relative to the concave arcuate reference surface of the first horizontal member and bearing a reference mark located in the projected plane of the reference surface, and a connecting member interconnecting and vertically spacing the first and second horizontal members.

The innermost end of the first horizontal member is elongate relative to the outermost end thereof, in the circumferential direction of the platen, so that the reference surface can engage the outer peripheral edge of the platen over a rather wide area. Furthermore, when the calibration device is in use, the outermost end of the first horizontal member and an outermost end of the second horizontal member opposite thereto are located further out than a portion of the outer peripheral edge of the abrasive pad that extended outwardly beyond the outer peripheral edge of the platen. Thus, the abrasive pad can be accommodated in a space between the horizontal members of the calibration device.

The connecting member can be unitary with the first and second horizontal members. In addition, a handle can be integrated with the connecting member so that the calibration device can be grasped.

The reference mark can be part of a scale formed on the second horizontal member. Also, the calibration device may include a scale extension disposed on the second member so as to be movable along the scale relative to the reference mark. The scale extension projects laterally from the second horizontal member in an arc having a curvature similar to (meaning the same or nearly the same as) that of the outer peripheral edge of the platen.

When the reference surface of the first horizontal member of the calibration device is butted against a portion of the outer peripheral edge of the platen adjacent the head of the pad conditioner, the location of the outermost portion of the head of the pad conditioner relative to the reference mark is readily observable. Thus, the extent to which the outermost portion of the head of the pad conditioner is vertically aligned relative to the outer peripheral edge of the platen can be easily and accurately determined, whereby the pad conditioner can be, in turn, accurately calibrated.

BRIEF DESCRIPTION OF THE DRAWINGS

These and other objects, features and advantages of the present invention will become more apparent by referring to the following detailed description of the preferred embodiments thereof made with reference to the attached drawings, of which.

DETAILED DESCRIPTION OF THE PREFERRED EMBODIMENTS

Figure 1:
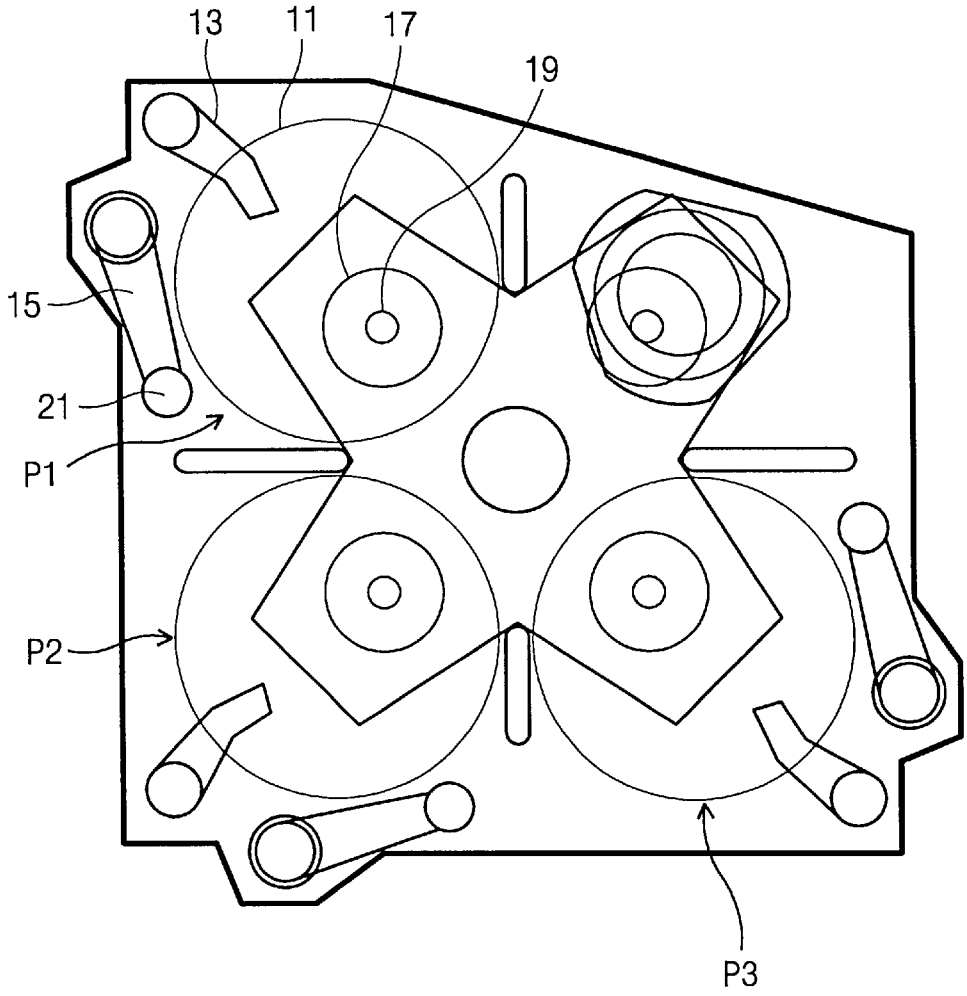
FIG. 1 is a schematic plan view of a conventional CMP machine.
Figure 2:
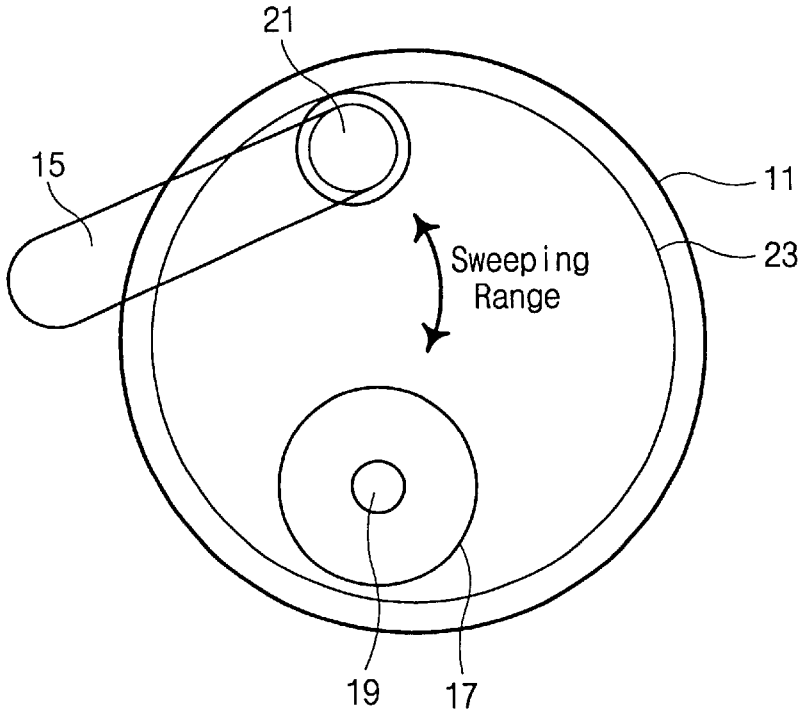
FIG. 2 is a plan view of one portion of the conventional CMP machine, showing a reference position of the pad conditioner head thereof.
Figure 3:
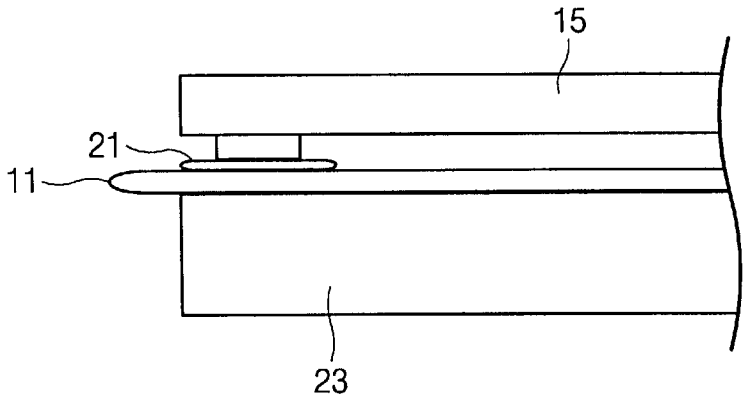
FIG. 3 is a side view of part of the conventional CMP machine, also showing a reference position of the pad conditioner head thereof.

The present invention will now be described more fully hereinafter with reference to FIGS. 4–8. In the drawings, like numbers refer to like elements throughout.

Figure 4:
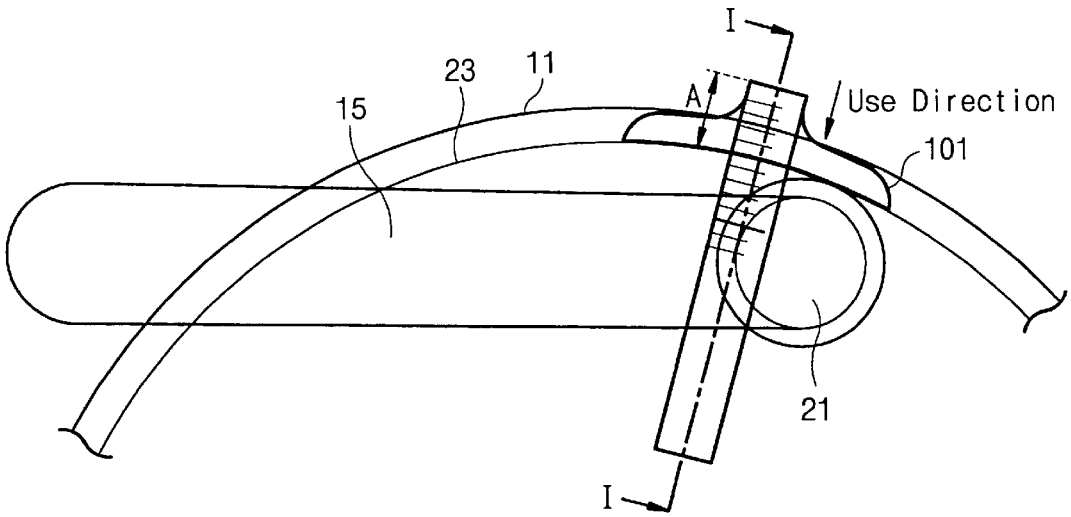
FIG. 4 is a plan view of a first embodiment of a calibration device for a pad conditioner head in accordance with a the present invention.
Figure 5:
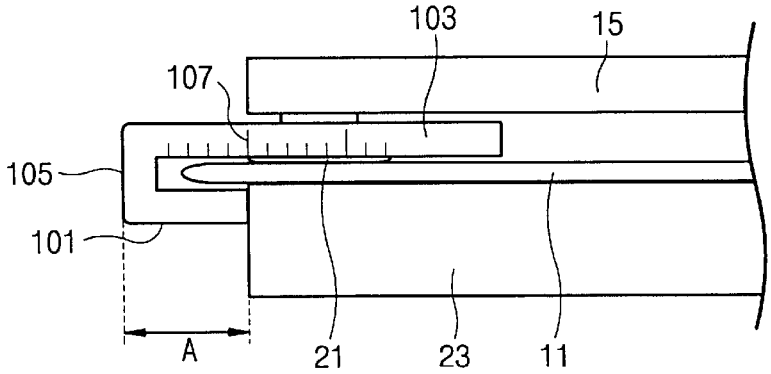
FIG. 5 is a side view of the calibration device taken along line I—I of FIG. 4.
Figure 6:
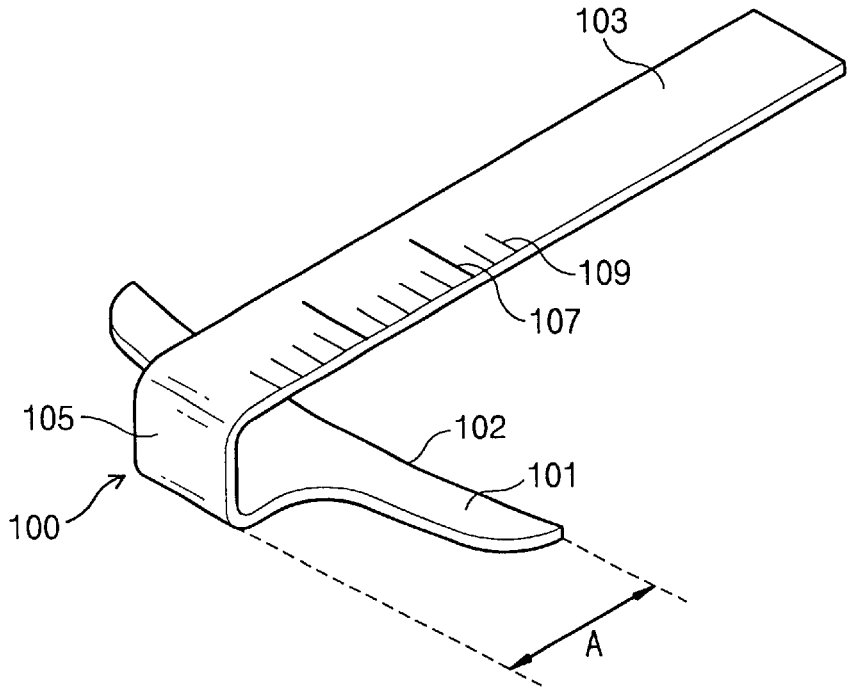
FIG. 6 is a perspective view of the calibration device shown in FIG. 4 and FIG. 5.

Referring now to FIG. 4 to FIG. 6, the calibration device 100 of the present invention includes a first horizontal member 101, a second horizontal member 103, and a vertical connecting member 105 connecting the first and second horizontal members 101, 103.

The first horizontal member 101 has radially innermost and outermost ends. The innermost end of the first horizontal member 101 is elongate in a horizontal direction corresponding to the circumferential direction of the platen 23. Thus, the inner end defines an arcuate reference surface 102 complementary to a portion of the outer peripheral edge of the platen 23 of the CMP machine. The inner end of the horizontal member 101 serves to ensure a proper calibration of the pad conditioner head 21 because its reference surface 102 can be mated with the outer peripheral edge of the platen 23. The outermost end of the first horizontal member 101 is spaced radially outwardly from the reference surface 102 by a distance A, as shown in FIG. 6.

The first and second horizontal members 101, 103 and the connecting member 105 are unitary but the device can be formed of separate but integral members. Furthermore, although the first horizontal member 101 of the calibration device is shown as being formed of plate stock, the first horizontal member 101 can be composed of bar stock instead.

The second horizontal member 103 of the calibration device 100 of the present invention is spaced upwardly from the first horizontal member 101 by the connecting member 105, as shown in FIG. 5 and FIG. 6. The second horizontal member 103 has a reference point that is located in a plane extending vertically from the reference surface 102. A reference mark 107 is provided at this reference point. The reference mark 107 may be part of a scale 109 comprising marks provided at certain intervals along the second horizontal member 103. Also, whereas the first horizontal member 101 extends only radially outwardly from the outer peripheral surface of the platen 23, i.e., radially outwardly relative to the reference mark 107, the second horizontal member 103 extends radially inwardly and radially outwardly relative to the reference mark 107. The scale 109 thus extends to both sides of the outer peripheral edge of the platen 23.

As shown in FIG. 5 and FIG. 6, the first horizontal member 101, the second horizontal member 103 and the connecting member 105 form a U-shaped structure. The distance between the outermost ends of the first and second horizontal members 101, 103 is also greater than the thickness of the abrasive pad. Accordingly, the calibration device 100 will not contact that portion of the edge of the abrasive pad 11 which extends outwardly beyond the outer peripheral edge of the platen 23. Also, the head 21 as well as the abrasive pad 11 can be accommodate in the space between the first horizontal member 101 and the second horizontal member 103.

When calibrating the head 21, the second horizontal member 103 is positioned over the head 21 while the standard surface 102 of the first horizontal member 101 is pressed against the outer peripheral edge of the platen 23. Accordingly, the calibration apparatus 100 can be used to measure the extent to which the outermost portion of the pad conditioner head 21 deviates from the reference mark 107 of the second horizontal member 103.

Figure 7:
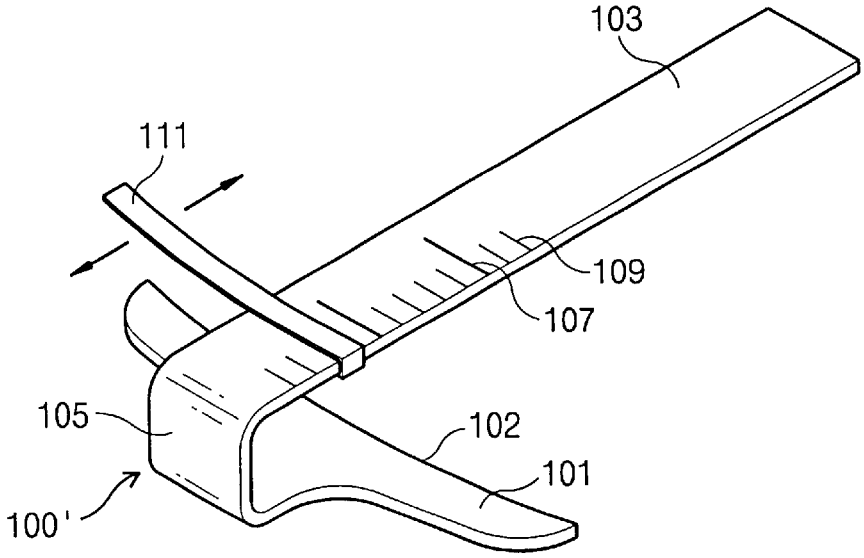
FIG. 7 is a perspective view of another embodiment of a calibration device in accordance with the present invention.

FIG. 7 is a perspective view of another calibration device 100' in accordance with the present invention.

As shown in FIG. 7, the calibration device 100' includes a scale extension 111 that can be used to better discern the relative position of the outermost portion of the pad conditioner head 21. The scale extension 111 is disposed on the second horizontal member 103 so as to be movable therealong inwardly and outwardly from the reference mark 107, i.e., along the scale 109. The scale extension 111 projects laterally from the second horizontal member 103 in an arc having a curvature similar to that of the outer peripheral edge of the platen 23. Thus, as shown in FIG. 8, the scale extension 111 can be moved to a position at which it extends from the scale 109 to a location vertically aligned with the outermost portion of the head 21.

More specifically, first the scale extension 111 is moved inwardly or outwardly from the reference mark 107 into contact with the outermost portion of the pad conditioner head 21. The scale extension 111 is now aligned closest to one of the markings of the scale 109. In this state, the scale 109 can be read to indicate the extent to which the outermost portion of the pad conditioner head 21 deviates from the reference mark 107 corresponding to the location of the outer peripheral edge of the platen 23. The position of the pad conditioner head 21 is then adjusted, if necessary, i.e., is calibrated, based on this reading of the scale 109.

Figure 8:
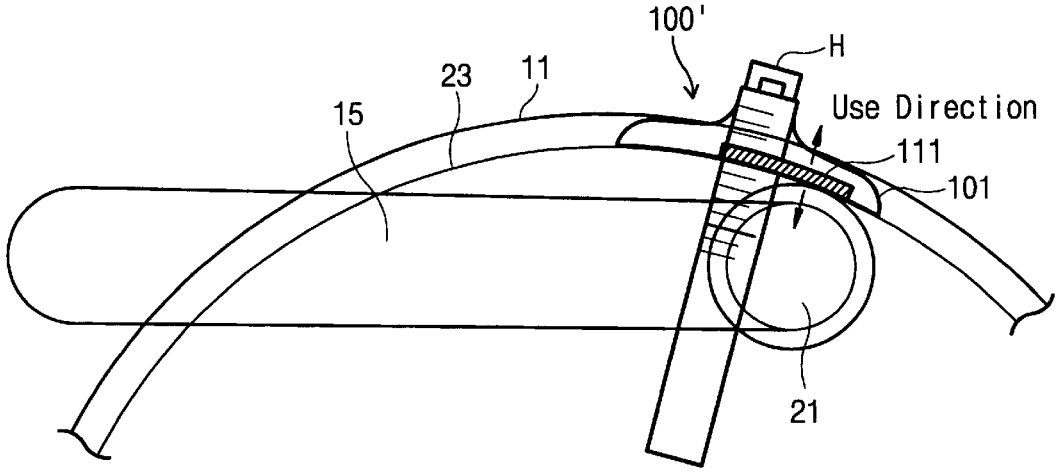
FIG. 8 is a plan view of the embodiment of the calibration device shown in FIG. 7.

Finally, as shown in FIG. 8, the calibration device 100' may have a handle H disposed on a certain portion thereof, e.g., on the connecting member 105, for facilitating its use.

As is apparent from the foregoing description, the calibration device of the present invention can be used to correctly calibrate the pad conditioner head by allowing the outer peripheral edge of the head to be accurately vertically aligned with the outer peripheral edge of the platen, even though the abrasive pad protrudes outwardly beyond the outer peripheral edge of the platen. Thus, the use of the calibration device ensures the effectiveness of the CMP process and hence, contributes to the production of high quality chips.

Finally, although the present invention has been shown and described in connection with the preferred embodiments thereof, various changes to and modifications of these preferred embodiments will become apparent to those of ordinary skill in the art. All such changes and modification that come within the scope of the appended claims are thus seen to be within the true spirit and scope of the invention.

What is claimed is:

1. A calibration device for use in calibrating a pad conditioner head of a chemical mechanical polishing (CMP) machine, said device comprising:

a first horizontal member having a radially innermost end and a radially outermost end, said innermost end defining a concave arcuate reference surface having a shape complementary to that of a portion of the outer peripheral edge of a platen of the CMP machine;

a second horizontal member spaced vertically from said first horizontal member, said second horizontal member extending radially relative to the concave arcuate reference surface of said first horizontal member, and said second horizontal member bearing a reference mark located in a plane projected vertically from said reference surface; and a connecting member interconnecting said first and second horizontal members.

2. The calibration device according to claim 1, wherein said first and second horizontal members and said connecting member are unitary.

3. The calibration device according to claim 1, wherein said innermost end of said first member is elongate, in comparison with said outermost end thereof, in the circumferential direction of said reference surface.

4. The calibration device according to claim 1, wherein said second member has a scale comprising markings spaced from one another along the length of said second horizontal member, respective ones of said markings being located on either side of said reference mark.

5. The calibration device according to claim 4, and further comprising a scale extension disposed on said second horizontal member so as to be movable therealong to either side of said reference mark, said scale extension projecting laterally from said second horizontal member.

6. The calibration device according to claim 5, wherein said scale extension projects laterally from said second horizontal member in an arc having a curvature similar to that of said reference surface.

7. The calibration device according to claim 1, and further comprising a handle extending from said connecting member and by which the device can be grasped.

8. The calibration device according to claim 1, and further comprising a scale extension disposed on said second horizontal member so as to be movable therealong to either side of said reference mark, said scale extension projecting laterally from said second horizontal member.

9. The calibration device according to claim 8, wherein said scale extension projects laterally from said second horizontal member in an arc having a curvature similar to that of said reference surface.

10. Chemical mechanical polishing apparatus comprising the combination of:

a chemical mechanical polishing (CMP) machine including a circular platen, an abrasive pad mounted to said platen, and a pad conditioner that conditions said abrasive pad, said pad conditioner including an arm having a first end and a second end, and a pad conditioner head mounted to the second end of said arm, the first end of said arm being pivotally supported in the machine such that the arm is swingable over a working range that allows said head to be swiped in an arc along the upper surface of said abrasive pad; and a calibration device for use in calibrating the pad conditioner head of said CMP machine, said calibration device comprising a first horizontal member having a radially innermost end and a radially outermost end, said innermost end defining a concave arcuate reference surface having a shape complementary to that of a portion of the outer peripheral edge of said circular platen, a second horizontal member spaced vertically from said first horizontal member, said second horizontal member extending radially relative to the concave arcuate reference surface of said first horizontal member, and said second horizontal member bearing a reference mark located in a plane projected vertically from said reference surface, and a connecting member interconnecting said first and second horizontal members, wherein when the reference surface of the first horizontal member of the calibration device is butted against a portion of the outer peripheral edge of said platen adjacent the head of said pad conditioner, the location of an outermost portion of the head of the pad conditioner relative to said reference mark is readily observable, whereby the extent to which the outermost portion of the head of the pad conditioner is vertically aligned relative to the outer peripheral edge of the platen can be determined.

11. The combination according to claim 10, wherein said first and second horizontal members and said connecting member of the calibration device are unitary.

12. The combination according to claim 10, wherein said innermost end of said first member of the calibration device is elongate, in comparison with said outermost end thereof, in the circumferential direction of said reference surface.

13. The combination according to claim 10, wherein said second member of the calibration device has a scale comprising markings spaced from one another along the length of said second member, respective ones of said markings being located on either side of said reference mark.

14. The combination according to claim 13, wherein said abrasive pad extends radially outwardly beyond the outer peripheral edge of said platen, and said first horizontal member has a length as taken between the inner and outermost ends thereof that is greater than the distance by which said abrasive pad extends beyond the outer peripheral edge of said platen, and said first and second horizontal members of the calibration device are spaced by said connecting member by an amount greater than the thickness of said abrasive pad, wherein an outermost portion of said abrasive pad can be accommodate in a space between said first and second horizontal members of the calibration device when the reference surface thereof is butted against the outer peripheral edge of said platen.

15. The combination according to claim 13, wherein said calibration device further comprises a scale extension disposed on said second horizontal member so as to be movable therealong to either side of said reference mark, said scale extension projecting laterally from said second horizontal member.

16. The combination according to claim 15, wherein said scale extension projects laterally from said second horizontal member in an arc having a curvature similar to that of the outer peripheral edge of said circular platen.

17. The combination according to claim 10, wherein said abrasive pad extends radially outwardly beyond the outer peripheral edge of said platen, and said first horizontal member has a length as taken between the inner and outermost ends thereof that is greater than the distance by which said abrasive pad extends beyond the outer peripheral edge of said platen, and said first and second horizontal members of the calibration device are spaced by said connecting member by an amount greater than the thickness of said abrasive pad, wherein an outermost portion of said abrasive pad can be accommodate in a space between said first and second horizontal members of the calibration device when the reference surface thereof is butted against the outer peripheral edge of said platen.

18. The combination according to claim 10, wherein said calibration device further comprises a handle extending from said connecting member and by which the device can be grasped.

19. The combination according to claim 10, wherein said calibration device further comprises a scale extension disposed on said second horizontal member so as to be movable therealong to either side of said reference mark, said scale extension projecting laterally from said second horizontal member.

20. The combination according to claim 19, wherein said scale extension projects laterally from said second horizontal member in an arc having a curvature similar to that of the outer peripheral edge of said circular platen.

* * * * *